US011313075B2

(12) United States Patent
Kühn et al.

(10) Patent No.: US 11,313,075 B2
(45) Date of Patent: Apr. 26, 2022

(54) MAN-MADE CELLULOSIC FIBER AND NONWOVEN PRODUCT OR FABRIC COMPRISING THE CELLULOSIC FIBER

(71) Applicants: KELHEIM FIBRES GMBH, Kelheim (DE); GLATFELTER GERNSBACH GMBH, Gernsbach (DE)

(72) Inventors: Jörg Kühn, Ötigheim (DE); Ingo Bernt, Regensburg (DE); Walter Roggenstein, Bad Abbach (DE); Bernd Seger, Bad Herrenalb (DE)

(73) Assignees: KELHEIM FIBRES GMBH, Kelheim (DE); GLATFELTER GERNSBACH GMBH, Gernsbach (DE)

( * ) Notice: Subject to any disclaimer, the term of this patent is extended or adjusted under 35 U.S.C. 154(b) by 320 days.

(21) Appl. No.: 16/344,896

(22) PCT Filed: Oct. 27, 2017

(86) PCT No.: PCT/EP2017/077598
§ 371 (c)(1),
(2) Date: Apr. 25, 2019

(87) PCT Pub. No.: WO2018/078094
PCT Pub. Date: May 3, 2018

(65) Prior Publication Data

US 2019/0257029 A1 Aug. 22, 2019

(30) Foreign Application Priority Data

Oct. 27, 2016 (EP) ..... 16196098

(51) Int. Cl.
*D06M 15/356* (2006.01)
*D04H 3/013* (2012.01)
(Continued)

(52) U.S. Cl.
CPC ..... *D06M 15/3562* (2013.01); *D04H 3/013* (2013.01); *D21C 9/002* (2013.01);
(Continued)

(58) Field of Classification Search
CPC ..... D06M 15/3562; D06M 15/356; D21C 9/002; D21C 9/005; D21C 9/00;
(Continued)

(56) References Cited

U.S. PATENT DOCUMENTS 3,905,864 A 9/1975 Curry et al.
4,199,367 A 4/1980 Smith
(Continued)

FOREIGN PATENT DOCUMENTS

GB 1394553 A 5/1975
RU 2226229 C2 3/2004
(Continued)

OTHER PUBLICATIONS

A. Torgnysdotter et al., "The Link Between the Fiber Contact Zone and the Physical Properties of Paper: A Way to Control Paper Properties," Journal of Composite Materials, vol. 41, No. 13/2007, pp. 1619-1633 (2007).
(Continued)

*Primary Examiner* — Elizabeth C Imani
(74) *Attorney, Agent, or Firm* — Venable LLP

(57) ABSTRACT

The present invention relates to a modified cellulosic fiber that comprises anionic moieties in an amount of more than 0.25 mol/kg of dry fiber and has applied thereon a polymeric modifying agent in an amount of from 0.5 wt. % to 5.0 wt. %, based on dry fiber, the polymeric modifying agent comprising cationic moieties with a charge of at least 1.5 meq per gram of polymer and the molar ratio of anionic moieties to cationic moieties contained in the fiber is in the range of from 1:1 to 25:1. The fiber according to the present
(Continued)

invention is characterized in that the anionic moieties are incorporated in the fiber and are from carboxymethylcellulose, and that the polymeric modifying agent comprising cationic moieties is selected from the group consisting of polydiallyldimethylammonium chloride (poly-DADMAC), poly(acrylamide-co-diallyldimethylammonium chloride) (PAM-DADMAC) and mixtures thereof. The invention furthermore relates to a nonwoven product or fabric comprising the modified cellulosic fiber.

29 Claims, 1 Drawing Sheet

(51) Int. Cl.

| | |
|---|---|
| ***D21H 13/08*** | (2006.01) |
| ***D21C 9/00*** | (2006.01) |
| ***D01F 2/08*** | (2006.01) |
| ***D04H 1/4258*** | (2012.01) |
| ***D21H 11/20*** | (2006.01) |

(52) U.S. Cl.
CPC ..... *D21H 13/08* (2013.01); *D01F 2/08* (2013.01); *D04H 1/4258* (2013.01); *D21C 9/005* (2013.01); *D21H 11/20* (2013.01)

(58) Field of Classification Search
CPC ..... D04H 3/013; D04H 1/4258; D21H 13/08; D21H 11/20; D01F 2/08
See application file for complete search history.

(56) References Cited

U.S. PATENT DOCUMENTS

| | | | | |
|---|---|---|---|---|
| 4,289,824 | A | 9/1981 | Smith | |
| 6,379,494 | B1 * | 4/2002 | Jewell | C08B 15/04 162/157.6 |
| 10,619,272 | B2 | 4/2020 | Bloom | |
| 2004/0129632 | A1 | 7/2004 | Le Brech et al. | |
| 2011/0177737 | A1 | 7/2011 | Bloom | |
| 2011/0177738 | A1 | 7/2011 | Bloom | |
| 2018/0340275 | A1 | 11/2018 | Bloom | |

FOREIGN PATENT DOCUMENTS

| | | | | |
|---|---|---|---|---|
| RU | 2514760 | C2 | 5/2014 | |
| WO | 1996026220 | A1 | 8/1996 | |
| WO | 0039389 | A1 | 7/2000 | |
| WO | 0039398 | A1 | 7/2000 | |
| WO | 0129309 | A1 | 4/2001 | |
| WO | WO-2008028998 | A1 * | 3/2008 | C08B 9/00 |
| WO | 2011012423 | A1 | 2/2011 | |

OTHER PUBLICATIONS

A. Torgnysdotter et al., "Study of the joint strength between regenerated cellulose fibres and its influence on the sheet strength," Nordic Pulp and Paper Research, vol. 18, No. Apr. 2003, pp. 455-459 (2003).

R. Sczech „Haftvermittlung von Polyelektrolyten zwischen Celluloseoberflächen PAM-DADMAC is mentioned as a well suited adhesion promotor between cellulosic surfaces (http://opus.kobv.de/ubp/volltexte/2006/733/pdf/sczech.pdf.

F. Weber et al., "The surface charge of regenerated cellulose fibres," Cellulose, 20(6), pp. 2719-2729 (2013).

International Preliminary Report on Patentability and Written Opinion issued in International Application No. PCT/EP2017/077598 dated Apr. 30, 2019 (7 pages).

International Search Report issued in International Application No. PCT/EP2017/077598 dated Dec. 15, 2017 (4 pages).

* cited by examiner

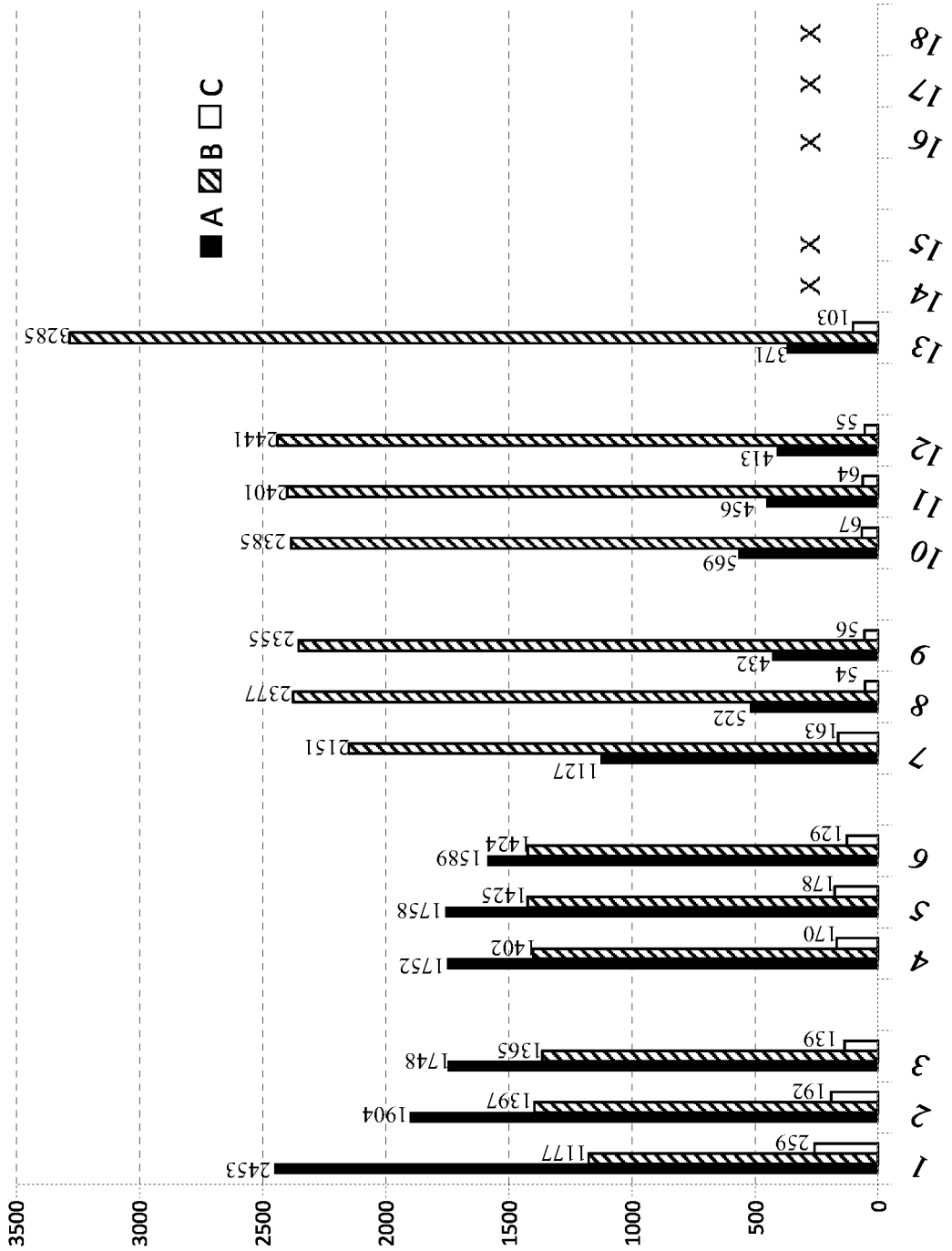
A
B
C
0
500
1000
1500
2000
2500
3000
3500
1
2
3
4
5
6
7
8
9
10
11
12
13
14
15
16
17
18
2453
1177
259
1904
1397
192
1748
1365
139
1752
1402
170
1758
1425
178
1589
1424
129
2151
1127
163
2377
522
54
2355
432
56
2385
569
67
2401
456
64
2441
413
55
3285
371
103

MAN-MADE CELLULOSIC FIBER AND NONWOVEN PRODUCT OR FABRIC COMPRISING THE CELLULOSIC FIBER

The present application is a national-stage entry under 35 U.S.C. § 371 of International Patent Application No. PCT/EP2017/077598, published as WO 2018/078094 A1, filed Oct. 27, 2017, which claims priority to European Patent Application No. 16196098.4, filed Oct. 27, 2016, the entire disclosure of each of which is incorporated by reference herein.

BACKGROUND OF THE INVENTION

The present invention relates to a modified cellulosic fiber, especially a modified viscose staple fiber, and to a nonwoven product or fabric comprising the modified cellulosic fiber.

In particular, the present invention relates to a man-made modified cellulosic fiber which is useful for applications like filtration papers, specialty papers and nonwoven products, especially hydroentangled nonwovens.

Under "specialty papers", papers are to be understood whose properties can be improved by the addition of fibers with defined geometrical parameters, such as cross section, length and diameter. Improved paper properties are e.g.: Increased or reduced porosity, improved strength (tensile strength, tear strength, burst strength), higher bulk, improved pliability.

It is known that the properties of papers and nonwoven products can be influenced by the addition of modified cellulosic compounds.

WO 1996/026220 discloses modified cellulosic particles which exhibit cationic groups also in the interior of the particles, and the use of said particles in the manufacture of paper.

WO 2011/012423 discloses regenerated cellulosic staple fibers in which carboxymethylcellulose (CMC) is incorporated, and their use in the manufacture of papers and nonwoven products. These fiber, therefore, have anionic properties. The improved binding properties of anionic viscose fibers are known.

An extensive overview of the interaction of polyelectrolytes in the fiber-fiber bonding is presented in the 2005 STFI-Packforsk report "On the nature of joint strength in paper—A review of dry and wet strength resins used in paper manufacturing" (http://www.innventia.com/documents/rapporter/stfi-packforsk%20report%2032.pdf).

In this report the following article is cited:

"The link between the fiber contact zone and the physical properties of paper: a way to control paper properties"; A. Torgnysdotter et al, Journal of composite materials; Vol. 41; No 13/2007, 1619-1633 (in the following referred to as "Torgnysdotter 2007"). Therein, the influence of cationic polelectrolytes on bond strength between anionic fibers is described. Especially, in this document, inter alia the properties of carboxymethylated cellulose which is modified with Polydiallyldimethylammonium chloride (Poly-DADMAC) were investigated.

Further studies in this regard have been published by the same author in Nordic Pulp and Paper Research 18(4), 2003, 455-459 (in the following referred to as "Torgnysdotter 2003").

Both in Torgnysdotter 2003 and Torgnysdotter 2007, rayon fibers were either surface charged or bulk charged by carboxymethylation. This means that the cellulose material of the fiber itself was derivatized to a certain degree to form carboxymethylcellulose.

According to Torgnysdotter 2003, both surface charged and bulk charged fibers were treated with poly-DADMAC. The maximum amount of poly-DADMAC adsorbed in both surface charged and bulk charged fibers was found to be about 3 mg/g fibers (=0.3%).

According to Torgnysdotter 2007, bulk charged fibers were treated with 25 g/kg poly-DADMAC, while Torgnysdotter 2007 is silent about the amount of poly-DADMAC absorbed onto the fibers.

In a dissertation written by R. Sczech, "Haftvermittlung von Polyelektrolyten zwischen Celluloseoberflächen" PAM-DADMAC is mentioned as a well suited adhesion promotor between cellulosic surfaces (http://opus.kobv.de/ubp/volltexte/2006/733/pdf/sczech.pdf).

The use of cationic polymers as dry-strength agents is well known in the paper industry.

In none of the documents of the prior art, however, a positive influence on the binding strength of anionic fibers by addition of PAM-DADMAC or poly-DADMAC is described. On the contrary, in Torgnysdotter 2007 a negative influence on tensile strength of paper made from anionically charged fibers is described (cf. FIG. 3, p. 1623). This is explained with a reduced contact area between the fibers caused by a de-swelling of anionic fibers upon addition of cationic polymers.

As regards the proposal of WO 2011/012423, the binding strength between anionic fibers alone is not strong enough to produce commercial quality papers from 100% viscose fiber, or to use the fiber as a full substitute for abacá fibers which are currently used for the modification of papers and nonwoven products.

Finally, cationic polyelectrolytes can be added to the paper recipe only in smaller amounts and are not washproof.

Further state of the art is known from WO 01/29309 A1, WO 00/39389, WO 00/39398 A1 and GB 1 394 553A.

It is an object of the present invention to provide a modified man-made cellulosic staple fiber which can be added in significant amounts to paper or to nonwoven products or the precursors thereof, whereby the properties of the end products are modified without a significant drop in the strength of the product.

It is in particular an object of the present invention to provide a modified man-made cellulosic staple fiber which enables reversible fiber-fiber bondings and/or which, when applied to paper or to nonwoven products, allows a redispersibility of the fibers in liquids or an aqueous fluid, such as water, without substantial deterioration of the strength of the paper or nonwoven products.

These objects are solved by a modified cellulosic fiber according to the present invention that is characterized in that it comprises anionic moieties in an amount of more than 0.25 mol/kg of dry fiber and has applied thereon a polymeric modifying agent in an amount of from 0.5 wt. % to 5.0 wt. %, based on dry fiber, the polymeric modifying agent comprising cationic moieties with a charge of at least 1.5 meq per gram of polymer and the molar ratio of anionic moieties to cationic moieties contained in the fiber being in the range of from 1:1 to 25:1 and which is characterized in that the anionic moieties are incorporated in the fiber and are from carboxymethylcellulose, and that the polymeric modifying agent comprising cationic moieties is selected from the group consisting of polydiallyldimethylammonium chloride (poly-DADMAC), poly(acrylamide-co-diallyldimethylammonium chloride) (PAM-DADMAC) and mixtures thereof.

SHORT DESCRIPTION OF THE DRAWINGS

FIG. 1 shows the influence on various properties of papers produced from various anionic and non-ionic viscose fibers with and without addition of PAM-DADMAC.

DETAILED DESCRIPTION OF THE INVENTION

Surprisingly, and contrary to the indications given in the documents of the prior art, it has been shown that a man-made cellulosic fiber having the combination of features according to the present invention is very useful in modifying the properties of papers and nonwoven products. In particular, the modified cellulosic fiber according to the present invention may enable reversible fiber-fiber bondings and may impart a paper or nonwoven product when applied to it with redispersibility in liquids or an aqueous fluid, such as water.

In the following, the term "polymeric modifying agent" means a polymeric modifying agent comprising cationic moieties with a charge of at least 1.5 meq per gram of polymer.

Furthermore, such a polymeric modifying agent is also referred to as "(cationic) polyelectrolyte" or "polymeric (cationic) polyelectrolyte".

In a preferred embodiment the modified cellulosic fiber according to the present invention is characterized in that the cellulosic fiber is a man-made cellulosic staple fiber, such as a viscose fiber or a lycoell fiber.

The term "man-made fiber" denotes a fiber that has been prepared by dissolving a cellulosic starting material, either with or without prior derivatisation, and spinning a fiber from the solution obtained by said dissolution. Thus, the term "man-made fiber" excludes natural cellulosic fibers, such as cotton. Further, cellulosic material such as cellulose pulp which has not been obtained by spinning a spinning solution, is also excluded. Well-known man-made cellulosic fibers include viscose fibers, including standard viscose fibers, modal fibers or polynosic fibers and lyocell fibers.

The term "staple fiber" is well known to the skilled artisan and denotes a fiber that has been cut into discrete lengths after having been spun.

Viscose fibers are fibers which are produced by the viscose process, wherein an alkaline solution of cellulose xanthogenate is spun into an acidic spin bath, whereupon underivatized cellulose is regenerated and precipitated in the form of a fiber.

Lyocell fibers are a type of solvent spun fibers produced according to the aminoxide process typically involving the dissolution of cellulose in N-methylmorpholine N-oxide and subsequent spinning to fibers.

In a preferred embodiment of the present invention the modified cellulosic fiber is characterized in that the molar ratio of anionic moieties to cationic moieties contained in the fiber is in the range of from 2:1 to 20:1, in particular of from 3:1 to 15:1, more in particular of from 4:1 to 12:1.

The modified cellulosic fiber of the present invention is characterized in that the anionic moieties comprise carboxyl (COOH) groups.

The amount of anionic moieties in the fiber can be measured by methods well-known to the skilled artisan. For example, the amount of COOH-groups in the fiber can be measured by way of e.g. acid-base titration. Other methods may rely on analytical derivatization. Furthermore, spectroscopic analysis methods are also available, cf. for example *The surface charge of regenerated cellulose fibers*, F. Weber et al., *Cellulose,* 2013, 20(6), 2719-2729. The measurement of the anionic moieties may be performed prior to treatment of the fiber with the polymeric modifying agent.

Furthermore, the modified cellulosic fiber according to the present invention is characterized in that the cationic moieties comprise ammonium groups, in particular quaternary ammonium groups.

Similar to the quantifaction of anionic moieties, the skilled artisan will be able to choose a suitable method for quantification of cationic moieties on the modified fiber. For example, in case the cationic moieties stem from nitrogen containing compounds, measurements based on the Kjeldahl method would be applicable.

Preferably the modified cellulosic fiber according to the present invention is characterized in that the polymeric modifying agent comprising cationic moieties exhibits a molar weight of from 100,000 g/mol to 500,000 g/mol, in particular of from 200,000 g/mol to 300,000 g/mol.

It has been found that the use of a polymeric cationic polyelectrolyte with a medium molecular weight, such as from 200,000 g/mol to 300,000 g/mol, results in advantageous properties of papers produced from the fiber according to the present invention.

The cellulosic staple may be treated with the polymeric cationic polyelectrolyte in a known way, especially by contacting the fiber with a solution or dispersion containing said polyelectrolyte in the desired amount.

The modified cellulosic fiber according to the present invention is characterized in that it comprises the anionic moieties incorporated in the fiber and has applied thereon the polymeric modifying agent comprising cationic moieties in an amount of from 0.5 wt. % to 5.0 wt. %, based on dry fiber.

This is, again, in contrast to Torgnysdotter 2003 wherein it is reported that the maximum amount of poly-DADMAC adsorbed onto to the fiber was about 0.3 wt. %. Without wishing to be bound to any theory, it is believed that the higher amount of polyelectrolyte which is adsorbed onto the fiber is due to the fact that the fiber is not carboxymethylated itself, but contains CMC incorporated in the fiber.

The modified cellulosic fiber according to the invention is characterized in that the anionic moieties, which are incorporated in the fiber, are from carboxymethylcellulose (CMC).

The manufacture of cellulosic staple fiber having CMC incorporated therein is well-known to the skilled artisan, such as, e.g. from U.S. Pat. Nos. 4,199,367 A and 4,289,824 A. Especially CMC is mixed into the spinning dope, e.g. a viscose dope, before spinning the fiber.

The CMC to be used may be a commercial product, with a degree of substitution (DS) of from 0.6-1.2, preferably 0.65-0.85, and a viscosity (2 wt. % solution; 25° C.) of from 30-800 mPas, preferably 50-100 mPas.

In contrast to Torgnysdotter 2003 and Torgnysdotter 2007, the fiber according to the invention is not surface charged or bulk charged by carboxymethylation. Rather, the cellulose fiber material of the fiber of the present invention is not derivatized itself, but carboxymethylcellulose is incorporated, i.e. dispersed within the matrix of the cellulose fiber material. As known to the skilled artisan, a cellulose fiber incorporating CMC can be produced by adding CMC to the spinning dope before spinning the fiber, such as a viscose spinning dope in the case of viscose fibers. Thus, the CMC is evenly distributed in the spinning dope and, as a consequence, is evenly distributed in the fiber spun therefrom, without derivatization of the cellulose fiber matrix itself.

In a preferred embodiment, the modified cellulosic fiber according to the present invention is characterized in that it comprises carboxymethylcellulose (CMC) incorporated in the fiber in an amount such that the fiber comprises of from 1 wt. % to 4 wt. % COOH-groups, preferably 1.5 wt. % to 3 wt. % COOH-groups, based on dry fiber.

The modified cellulosic fiber according to the present invention is characterized in that it comprises anionic moieties and has applied thereon a polymeric modifying agent comprising cationic moieties in amount of from 0.5 wt. % to 5.0 wt. %, based on dry fiber, wherein the polymeric modifying agent comprising cationic moieties is selected from the group consisting of polydiallyldimethylammonium chloride (poly-DADMAC), poly(acrylamide-co-diallyldimethylammonium chloride) (PAM-DADMAC) and mixtures thereof.

Preferably the modified cellulosic fiber according to the present invention is characterized in that the amount of the polymeric modifying agent comprising cationic moieties is from 0.6 wt. % to 4.0 wt. %, in particular of from 0.7 wt. % to 3.0 wt. %, in particular of from 0.75 wt. % to 2.0 wt. %, such as of from 1.0 wt. % to 1.75 wt. %, each based on dry fiber.

In a preferred embodiment the modified cellulosic fiber according to the invention is characterized in that it is capable of providing reversible bonds to another modified cellulosic fiber, and/or it is dispersible in an aqueous fluid.

Preferably the modified cellulosic fiber according to the present invention is used for the manufacture of a nonwoven product or paper.

It has been found that, in terms of the properties of papers containing the fiber according to the present invention, very advantageous results can be obtained with a combination of comparably high anionic charge of the fiber (in terms of the amount of COOH-groups) with a comparably low content of polymeric cationic polyelectrolyte.

Thus, in a further aspect the present invention provides paper or non-woven product comprising a modified cellulosic fiber according to the present invention.

The paper or non-woven material according to the present invention can for instance be a packaging material, such as a packaging material for food packaging; a filter material, especially a filtration paper, such as for infusion beverages, e.g. tea and coffee, or a filter material for oil filtration; a composite laminate, such as an overlay paper; an air-laid non-woven web, such as a hygiene and personal care product, home care product, e.g. wipes, towels, napkins and tablecloths, a speciality paper, e.g. wallcoverings (wall paper), mattress and upholstery padding. Preferably, the paper or non-woven web according to the present invention is a filter material for tea and coffee.

The paper or non-woven material according to the present invention may in particular be a wet-laid or an air-laid paper or non-woven material, preferably a wet-laid paper or non-woven material. In other words, the paper or non-woven material may be formed for instance by a wet-laid process, such as by a conventional paper-making process using a paper machine, e.g. an inclined wire paper machine, or an air-laid process, such as a dry-forming air-laid non-woven manufacturing process. A conventional paper-making process is described for instance in US 2004/0129632 A1, the disclosure of which is incorporated herein by reference. A suitable dry-forming air-laid non-woven manufacturing process is described for instance in U.S. Pat. No. 3,905,864, the disclosure of which is incorporated herein by reference.

The grammage of the paper or non-woven web is not particularly limited. Typically, the paper or non-woven web has a grammage of from 5-2000 g/m$^2$, preferably of from 5-600 g/m$^2$, more preferable of from 8.5-120 g/m$^2$.

Preferably a nonwoven product or paper according to the present invention is characterized in that it comprises the modified cellulosic fiber according to the present invention in an amount of at least 5 wt. %, in particular of from 25 wt. % to 100 wt. %, in particular of from 40 wt. % to 90 wt. %, in particular of from 50 wt. % to 80 wt. %.

In a preferred embodiment a nonwoven product or paper according to the present invention is characterized in that it further comprises one or more substances selected from the group consisting of cellulose, viscose, lyocell, cotton, hemp, manila, jute, sisal, rayon, abaci. soft wood pulp, hard wood pulp, synthetic fibers or heat-sealable fibers, including polyethylene (PE), polypropylene (PP), polyester, such as polyethylene terephthalate (PET) and poly(lactic acid) (PLA), bicomponent fibers, preferably bicomponent fibers of the sheath-core type.

Bicomponent fibers are composed of two sorts of polymers having different physical and/or chemical characteristics, in particular different melting characteristics. A bicomponent fiber of the sheath-core type typically has a core of a higher melting point component and a sheath of a lower melting point component. Examples of bicomponent fibers, suitable for use in the present invention, include PET/PET fibers, PE/PP fibers, PET/PE and PLA/PLA fibers.

Instead of specialty natural fibers (e.g. abacá hemp, kenaf), regenerated cellulosic fibers can be used, either in 100% or in a blend with wood pulp. It is in the nature of natural cellulosic fibers that their properties may vary considerably, and also the supply of these fibers can vary depending on each harvest. Man made cellulosic fibers are of consistent quality, and their supply is stable due to the use of commonly available wood pulp as a raw material.

Preferably a nonwoven product or paper according to the present invention is characterized in that it does not comprise or substantially does not comprise any binder. With regard to embodiments comprising "substantially no binder", binders if any may still be present in relatively minor amounts of up to 3 wt. %, up to 2 wt. %, or up to 1 wt. % based on the total weight of the nonwoven product or paper. In the art of paper making the term "binder" denotes chemicals that are added during the paper-making process to modify strength of the paper.

A process for the manufacture of a modified cellulosic fiber according to the present invention comprises the steps of providing a cellulosic fiber with anionic moieties as defined above in an amount of more than 0.25 mol/kg and treating the cellulosic fiber comprising anionic moieties with the polymeric modifying agent comprising cationic moieties as defined above.

If the fiber of the present invention is to be used for the production of wet-laid nonwovens or papers, the decitex of the fiber according to the present invention is preferably of from 0.5 dtex to 12 dtex, most preferably of from 0.5 dtex to 3.5 dtex. The length of the fiber may range of from 2 mm to 15 mm, preferably of from 3 mm to 12 mm. The cross-section of the fiber may have a broad variety of shapes, e.g. round, serrated, flat, or multilobal such as trilobal.

If the fiber of the present invention is to be used for the production of dry-laid nonwovens, such as for spunlace applications, the decitex of the fiber according to the present invention is preferably of from 0.5 dtex to 12 dtex, most preferably of from 0.5 dtex to 3.5 dtex. The length of the fiber may range of from 20 mm to 80 mm, preferably of from 30 mm to 60 mm. The cross-section of the fiber may have a broad variety of shapes, e.g. round, serrated, flat, or multilobal such as trilobal.

It has been found that the fiber of the present invention allows an addition of more than 10 wt. % of the fiber in a recipe for filtration papers without a significant drop in paper strength.

The use of fibers according to the present invention enables the production of papers with high porosity while maintaining sufficient strength for the target applications.

EXAMPLES

Throughout the following examples, the parameter "porosity" (air permeability) was determined with an AKUSTRON Air-Permeability apparatus (Thwing-Albert, West Berlin, USA) according to the manufacturer's instructions.

Tensile strength was measured according DIN EN ISO 1924-2.

Tear strength was measured based on DIN EN 21974 grammage related.

Example 1

Material Used:

Reference fiber:

Viscose fiber Danufil® 0.9 dtex/6 mm (Fiber 1.1)

Anionic viscose fiber:

Viscose fiber with CMC-Incorporation and 2.4 wt. % COOH (see WO 2011/012423A1) was produced in 0.9 dtex/6 mm (Fiber 1.2)

PAM-DADMAC:

Poly(acrylamide-co-diallyldimethylammonium chloride) (PAM-DADMAC), 98%

CAS: 26590-05-6

Molecular weight: $10^5$ g/mol 55 wt. % Acrylamide (Sigma-Aldrich Chemie GmbH, Taufkirchen)

Procedure:

Production of Fibers:

200 g of Fiber 1.2 were added to 2 liters of a 1 wt. % PAM-DADMAC solution in $H_2O$ and stirred for 5 minutes.

The fibers were filtered off and the remaining liquid was squeezed out, until a total weight of 800 g was reached. The fiber was then washed with deionized water and squeezed out again.

The fiber prepared by this procedure (Fiber 1.3) was analyzed to have a nitrogen content of 0.89 wt. % which corresponds to a level of 6 wt. % PAM-DADMAC on fiber.

Test Paper Production:

The paper was produced in a Rapid Köthen Lab sheet former. The test sheets were dried in an oven at 105° C. without any pressure load.

The fibers 1.1-1.3 were added to previously refined reference pulps in an overall amount of 20 wt. %, 50 wt. % and 80 wt. %, respectively. Test sheets were produced in a grammage of 30 g/m$^2$.

The test sheets were tested for tensile strength, tear strength and porosity (air permeability).

Test Results:

Compared to the sheets produced with the reference fiber (Fiber 1.1) the following improvements were achieved (Mixture share of 80% viscose fiber and 20% reference pulp):

Sheets with anionic viscose-fiber (Fiber 1.2)

Tensile strength: approx. +65%

Tear strength: approx. +100%

Porosity: approx. −9%

| Parameter | Fiber 1.1 | Fiber 1.2 (Fiber 1.1 but anionic) |
|---|---|---|
| Breaking length [m] | 584 | 967 |
| Tear strength [−] | 61 | 124 |
| Porosity [1/m$^2$*s] | 1463 | 1328 |

Sheets with Viscose fiber according to invention (Fiber 1.3)

Tensile strength: approx. +400%

Tear strength: approx. +650%

Porosity: approx. −14%

| Parameter | Fiber 1.1 | Fiber 1.3 (Fiber 1.2 with PAM DADMAC) |
|---|---|---|
| Tensile strength [m] | 584 | 2952 |
| Tear strength [−] | 61 | 459 |
| Porosity [1/m$^2$*s] | 1463 | 1251 |

Compared to a sheet made from 100% reference pulp, with all viscose fibers the porosity is increased as desired (+50%-+300%, depending on % viscose fiber).

Example 2

Material Used:

Anionic viscose fiber:

Anionic viscose fibers were produced in 1.3 dtex/6 mm (see WO 2011/012423A1) with different percentages of CMC incorporation. The grade of CMC incorporation was characterized by the percentage of carboxylic groups in the fiber.

Fiber 2.1: 1.3 wt. % COOH

Fiber 2.2: 1.7 wt. % COOH

Fiber 2.3: 2.3 wt. % COOH

PAM-DADMAC:

Poly(acrylamide-co-diallyldimethylammonium chloride) (PAM-DADMAC), 98%

CAS: 26590-05-6

Molecular weight: $10^5$ g/mol 55 wt. % Acrylamide (Sigma-Aldrich Chemie GmbH, Taufkirchen)

Procedure:

Production of Fibers:

The fibers were treated with polyelectrolyte in a bath procedure analogous to Example 1. Different levels of polyelectrolyte were set by using different bath concentrations.

The add-on level of polyelectrolyte on the fibers was determined by nitrogen analysis on the produced test paper sheets.

| Fiber ID | wt. % COOH | Polyelectrolyte | Polyelectrolyte on fiber wt. % |
|---|---|---|---|
| Fiber 2.1.1 | 1.3 | PAM-DADMAC | 2.3 |
| Fiber 2.1.2 | 1.3 | PAM-DADMAC | 2 |
| Fiber 2.1.2 | 1.3 | PAM-DADMAC | 2.5 |
| Fiber 2.2.1 | 1.7 | PAM-DADMAC | 2.4 |
| Fiber 2.2.2 | 1.7 | PAM-DADMAC | 2.6 |
| Fiber 2.2.3 | 1.7 | PAM-DADMAC | 3.3 |
| Fiber 2.3.1 | 2.3 | PAM-DADMAC | 2.2 |

-continued

| Fiber ID | wt. % COOH | Polyelectrolyte | Polyelectrolyte on fiber wt. % |
|---|---|---|---|
| Fiber 2.3.2 | 2.3 | PAM-DADMAC | 3.2 |
| Fiber 2.3.3 | 2.3 | PAM-DADMAC | 4 |

Test Paper Production:

The test paper was produced in a Rapid Kothen Lab sheet former. The test paper sheets were dried in an oven at 105° C. without any pressure load.

Test sheets were produced in a basis weight of 30 g/m$^2$ from 100% modified viscose fiber and from 80 wt. % modified viscose fiber with addition of 20 wt. % of a reference pulp.

The test sheets were tested for tensile strength, tear strength and porosity (air permeability).

Test Results:

| ID | wt. % COOH | Polyelectrolyte | Polyelectrolyte on Fiber [wt. %] | Breaking length-80% modified viscose fiber [m] | Porosity-80% m.v.f. [l/m$^2$*s] | Breaking length-100% m.v.f. [m] | Porosity-100% m.v.f. [l/m$^2$*s] |
|---|---|---|---|---|---|---|---|
| Fiber 2.1.1 | 1.3 | PAM-DADMAC | 2.3 | 1552 | 2250 | 374 | 3259 |
| Fiber 2.1.2 | 1.3 | PAM-DADMAC | 2.0 | 1086 | 2146 | 256 | 3082 |
| Fiber 2.1.3 | 1.3 | PAM-DADMAC | 2.5 | 1107 | 2184 | 234 | 3104 |
| Fiber 2.2.1 | 1.7 | PAM-DADMAC | 2.4 | 1857 | 1815 | 741 | 2538 |
| Fiber 2.2.2 | 1.7 | PAM-DADMAC | 2.6 | 1285 | 1793 | 347 | 2565 |
| Fiber 2.2.3 | 1.7 | PAM-DADMAC | 3.3 | 1336 | 1823 | 383 | 2648 |
| Fiber 2.3.1 | 2.3 | PAM-DADMAC | 2.2 | 2312 | 1696 | 1384 | 2328 |
| Fiber 2.3.2 | 2.3 | PAM-DADMAC | 3.2 | 1739 | 1714 | 811 | 2398 |
| Fiber 2.3.3 | 2.3 | PAM-DADMAC | 4.0 | 1568 | 1736 | 755 | 2338 |

m.v.f. . . . modified viscose fiber

A reference sheet with 80 wt. % untreated anionic fiber (Fiber 1.2) showed a breaking length of only 539 m, which is 30%-40% of the strength achieved with the treated fiber, depending on the PAM-DADMAC add-on.

The porosity of the produced sheets was within the desired range.

It is shown that a higher anionic charge of the fiber (wt. % COOH) and a lower level of the cationic polyelectrolyte give the best results for tensile strength.

Example 3

Material Used:

Anionic viscose fiber:

Fiber 2.3 from Example 2

Cationic viscose fiber:

Danufil® DeepDye 1.7 dtex/5 mm (Kelheim Fibers GmbH, Kelheim)

Non ionic (regular) viscose fiber:

Danufil® 1.7 dtex/5 mm (Kelheim Fibers GmbH, Kelheim)

PAM-DADMAC:

Poly(acrylamide-co-diallyldimethylammonium chloride) (PAM-DADMAC), 98%

CAS: 26590-05-6

Molecular weight: $10^5$ g/mol 55 wt. % Acrylamide (Sigma-Aldrich Chemie GmbH, Taufkirchen)

Procedure:

The fibers were treated with polyelectrolyte in a bath procedure analogous to Example 1. Different levels of polyelectrolyte were set by using different bath concentrations.

Test Paper Production:

The paper was produced in a Rapid Köthen Lab sheet former. The test paper sheets with 30 g/m$^2$ were dried in an oven at 105° C. without any pressure load.

Test results are depicted in FIG. 1 and show that only the combination of anionic fiber with cationic polyelectrolyte gives a significant improvement in paper strength.

FIGURE LEGEND FOR FIG. 1

X . . . no sheet formation achievable

A . . . Tensile strength (breaking length) [m]

B . . . Porosity [1/m$^2$*s]

C . . . Tear strength [−]

1 . . . 50% anionic viscose+1.3% PAM DADMAC

2 . . . 50% cationic viscose+1.3% PAM DADMAC

3 . . . 50% non-ionic viscose+1.3% PAM DADMAC

4 . . . 50% anionic viscose without PAM DADMAC

5 . . . 50% cationic viscose without PAM DADMAC

6 . . . 50% non-ionic viscose without PAM DADMAC

7 . . . 80% anionic viscose+1.3% PAM DADMAC

8 . . . 80% cationic viscose+1.3% PAM DADMAC

9 . . . 80% non-ionic viscose+1.3% PAM DADMAC

10 . . . 80% anionic viscose without PAM DADMAC

11 . . . 80% cationic viscose without PAM DADMAC

12 . . . 80% non-ionic viscose without PAM DADMAC

13 . . . 100% anionic viscose+1.3% PAM DADMAC

14 . . . 100% cationic viscose+1.3% PAM DADMAC

15 . . . 100% non-ionic viscose+1.3% PAM DADMAC

16 . . . 100% anionic viscose without PAM DADMAC

17 . . . 100% cationic viscose without PAM DADMAC

18 . . . 100% non-ionic viscose without PAM DADMAC

Example 4

Material Used:

Anionic viscose fiber:

Anionic viscose fibers were produced in 1.3 dtex/4 mm (see WO2011/012423A1) with CMC incorporation. The grade of CMC incorporation was characterized by the percentage of carboxylic groups in the fiber, which was analyzed as 2 wt. %.

Poly-DADMAC:

Poly(diallyldimethylammonium chloride)

CAS.: 26062-79-3

Mw<100,000 (low molecular weight)

(Sigma-Aldrich Chemie GmbH, Taufkirchen)

Poly-DADMAC:

Poly(diallyldimethylammonium chloride)

CAS.: 26062-79-3

Mw 200,000-300,000 (medium molecular weight)

(Sigma-Aldrich Chemie GmbH, Taufkirchen)

Poly-DADMAC:

Poly(diallyldimethylammonium chloride)

CAS.: 26062-79-3

Mw 400,000-500,000 (high molecular weight)

(Sigma-Aldrich Chemie GmbH, Taufkirchen)

PAM-DADMAC 1:

Poly(acrylamide-co-diallyldimethylammonium chloride) (PAM-DADMAC)

CAS: 26590-05-6

Mackernium 007®

(Rhodia UK Ltd; Oldbury)

PAM-DADMAC 2:

Poly(acrylamide-co-diallyldimethylammonium chloride) (PAM-DADMAC)

CAS: 26590-05-6

Mackernium 007N®

(Rhodia UK Ltd, Oldbury)

Polyethylenimine (PEI):

CAS: 25987-06-8

Lupasol G35®

(BASF Corporation, Ludwigshafen)

Procedure:

The viscose fibers were treated with the different cationic polyelectrolytes in a bath procedure analogous to Example 1. Different levels of polyelectrolyte were set by using different bath concentrations. Polyethylenimine was added with a target of 1.5% polyelectrolyte on fiber, but it was observed that this polymer had a very high affinity to the anionic fiber resulting in an add-on level of 3.62%.

The add-on level of polyelectrolyte on the fibers was determined by nitrogen analysis:

| Fiber ID | Polyelectrolyte | Polyelectrolyte on fiber [wt. %] |
|---|---|---|
| Fiber 4.1 | Poly-DADMAC; medium MW | 0.28 |
| Fiber 4.2 | Poly-DADMAC; medium MW | 1.25 |
| Fiber 4.3 | Poly-DADMAC; medium MW | 1.75 |
| Fiber 4.4 | Poly-DADMAC; low MW | 2.76 |
| Fiber 4.5 | Poly-DADMAC; high MW | 1.48 |
| Fiber 4.6 | Poly-DADMAC; medium MW | 1.53 |
| Fiber 4.7 | PAM-DADMAC 1 higher charge | 1.26 |
| Fiber 4.8 | PAM-DADMAC 2 | 1.55 |
| Comparative Fiber 4.9 | Polyethylenimine | 3.62 |

Test Paper Production:

The paper was produced in a Rapid Köthen Lab sheet former. The test paper sheets were dried in an oven at 105° C. without any pressure load.

Test sheets were produced in a basis weight of 30 g/m$^2$ from 100% of modified viscose fiber and from 80 wt. % of modified viscose fiber with addition of 20 wt. % of a reference fiber.

The test sheets were tested for tensile strength, tear strength and porosity (air permeability).

Test Results:

| ID | Poly-electrolyte | Poly-electrolyte on Fiber [wt. %] | Breaking length-80% modified viscose fiber [m] | Porosity-80% m.v.f. [l/m$^2$*s] | Breaking length-100% m.v.f. [m] | Porosity-100% m.v.f. [l/m$^2$*s] |
|---|---|---|---|---|---|---|
| 4.1 | Poly-DADMAC medium MW | 0.28 | 578 | 2042 | 177 | 2870 |
| 4.2 | Poly-DADMAC medium MW | 1.25 | 2154 | 1932 | 792 | 2739 |
| 4.3 | Poly-DADMAC medium MW | 1.75 | 2023 | 1848 | 939 | 2886 |
| 4.4 | Poly-DADMAC low MW | 2.76 | 1840 | 1987 | 770 | 2905 |
| 4.5 | Poly-DADMAC high MW | 1.48 | 1744 | 2004 | 761 | 3027 |
| 4.6 | Poly-DADMAC medium MW | 1.53 | 1765 | 1943 | 954 | 2750 |
| 4.7 | PAM-DADMAC 1 higher charge | 1.26 | 864 | 2025 | 214 | 3053 |
| 4.8 | PAM-DADMAC 2 | 1.55 | 1069 | 1955 | 339 | 2915 |
| 4.9 | Polyethylenimine | 3.62 | 882 | 2061 | 81 | 2905 |

m.v.f. . . . modified viscose fiber

The results show that Poly-DADMAC in a medium molecular weight is an especially suited polymer for the use in the present invention.

On the other hand side the fiber with a high level of polyethylenimine on fiber showed inferior performance in terms of paper strength. In this example the molar ratio of anionic moieties to cationic moieties (in mEq/mEq) is only 0.5 and thus smaller than 1, resulting in an insufficient improvement of paper strength.

Example 5

Material Used:

Anionic viscose fiber:

Anionic viscose fibers were produced in 1.3 dtex/4 mm (see WO 2011/012423A1) with CMC incorporation. The grade of CMC incorporation was characterized by the percentage of carboxylic groups in the fiber, which was analyzed as 2.6 wt. %.

Poly-DADMAC:

Poly(diallyldimethylammonium chloride)

CAS-Nr.: 26062-79-3

Mw<100,000 (low molecular weight)

(Sigma-Aldrich Chemie GmbH, Taufkirchen)

Poly-DADMAC:

Poly(diallyldimethylammonium chloride)

CAS-Nr.: 26062-79-3

Mw 200,000-300,000 (medium molecular weight)

(Sigma-Aldrich Chemie GmbH, Taufkirchen)

Procedure:

The viscose fibers were treated with the different cationic polyelectrolytes in a bath procedure analogous to Example 1, with the exception that no washing of the treated fiber took place.

Different levels of polyelectrolyte were set by using different bath concentrations.

The add-on level of polyelectrolyte on the fibers was determined by nitrogen analysis:

| Sample ID | Polyelectrolyte | Poly-DADMAC on fiber [wt. %] |
|---|---|---|
| Fiber 5.1 | Poly-DADMAC-medium MW | 0.30 |
| Fiber 5.2 | Poly-DADMAC-medium MW | 1.00 |
| Fiber 5.3 | Poly-DADMAC-low MW | 0.55 |
| Fiber 5.4 | Poly-DADMAC-low MW | 1.60 |

Test paper production: The paper was produced in a Rapid Kothen Lab sheet former. The test sheets were dried in an oven at 105° C. without any pressure load.

Test sheets were produced in a basis weight of 30 g/m$^2$ from 100% of modified viscose fiber, after applying a series of washes.

The add-on level of polyelectrolyte on the fibers was determined by nitrogen analysis on selected test sheets:

| Test sheet | Poly-DADMAC on fiber [wt. %] |
|---|---|
| Poly-DADMAC medium MW, 1%-no wash | 1.0 |
| Poly-DADMAC medium MW, 1%-4 washes | 1.0 |
| Poly-DADMAC medium MW, 1%-10 washes | 1.0 |

Even after 10 washes the Poly-DADMAC level on the paper sheets is identical to the level on the provided modified viscose fiber. This shows that in the chosen concentration the polyelectrolyte is quantitatively retained on the fiber and is not washed out in the paper making process or the final application.

The test sheets were tested for tensile strength (breaking length) and porosity (air permeability).

Test Results:

Retention of Polyelectrolyte After Washing

| Parameter | Without washing Medium MW Poly-DADMAC 0.75 wt. % | 4× washed Medium MW Poly-DADMAC 0.75 wt. % | 10× washed Medium MW Poly-DADMAC 0.75 wt. % |
|---|---|---|---|
| Breaking length [m] | 901 | 1161 | 1104 |
| Porosity [L/m$^2$s] | 2791 | 2730 | 2760 |

Even after several washings of the fiber, the same tensile strength in the paper is achieved, confirming the quantitative retention of the polyelectrolyte on the fiber, without losing efficiency.

Influence of Add-on Level of Polyelectrolyte on Breaking Length

| Parameter | 100% Low MW Poly-DADMAC 0.25 wt. % | 100% Medium MW Poly-DADMAC 0.25 wt. % | 100% Low MW Poly-DADMAC 0.75 wt. % | 100% Medium MW Poly-DADMAC 0.75 wt. % |
|---|---|---|---|---|
| Breaking length [m] | 96 | 132 | 648 | 1019 |

In papers from 100% viscose fiber, those made with polyelectrolyte add-ons≥1% showed significant higher strength than those which were made from fibers with <1% add-on. Together with the results from Example 4 this indicates, that there is an optimum add-on level of around 1% polyelectrolyte.

Influence of Molecular Weight of the Polyelectrolyte

Papers were formed after different wash cycles:

| | without washing | 2× washing | 4× washing | 6× washing | 10× washing |
|---|---|---|---|---|---|
| | Amount of Fiber in Paper | | | | |
| Parameter | 100% Low MW Poly-DADMAC 0.75 wt. % | 100% Low MW Poly-DADMAC 0.75 wt. % | 100% Low MW Poly-DADMAC 0.75 wt. % | 100% Low MW Poly-DADMAC 0.75 wt. % | 100% Low MW Poly-DADMAC 0.75 wt. % |
| Breaking length [m] | 794 | 663 | 713 | 526 | 588 |
| Porosität [1/m$^2$*s] | 2744 | 2837 | 2757 | 2762 | 2790 |

| Parameter | without washing 100% Medium MW Poly-DADMAC 0.75 wt. % | 2× washing 100% Medium MW Poly-DADMAC 0.75 wt. % | 4× washing 100% Medium MW Poly-DADMAC 0.75 wt. % | 6× washing 100% Medium MW Poly-DADMAC 0.75 wt. % | 10× washing 100% Medium MWPoly-DADMAC 0.75 wt. % |
|---|---|---|---|---|---|
| Breaking length [m] | 901 | 1166 | 1161 | 1275 | 1104 |
| Porosity [1/m$^2$*s] | 2791 | 2885 | 2730 | 2620 | 2760 |

In each case the medium molecular weight poly-DADMAC gives a higher strength in the produced test sheets, indicating that there is a preferred molecular weight for Poly-DADMAC>100,000.

Porosity of the produced papers was within expectation and no porosity losses were observed.

What is claimed is:

1. A modified cellulosic fiber comprising:

incorporated anionic moieties in an amount of more than 0.25 mol/kg, based on the dry fiber, and a polymeric modifying agent applied to the fiber in an amount of from 0.5 wt. % to 5.0 wt. %, based on the dry fiber, wherein the polymeric modifying agent has cationic moieties with a charge of at least 1.5 meq per gram of polymer, and comprises polydiallyldimethylammonium chloride (poly-DADMAC), poly(acrylamide-co-diallyldimethylammonium chloride) (PAM-DADMAC) and mixtures thereof wherein the molar ratio of anionic moieties to cationic moieties is in the range of from 1:1 to 25:1, and wherein the anionic moieties comprise carboxymethylcellulose.

2. The modified cellulosic fiber according to claim 1, wherein the cellulosic fiber is a man-made cellulosic staple fiber.

3. The modified cellulosic fiber according to claim 1, wherein the molar ratio of anionic moieties to cationic moieties is in the range of from 4:1 to 12:1.

4. The modified cellulosic fiber according to claim 1, wherein the polymeric modifying agent exhibits a molar weight from 100,000 g/mol to 500,000 g/mol.

5. The modified cellulosic fiber according to claim 1, wherein an amount of the carboxymethylcellulose (CMC) in the fiber is from 1 wt. % to 4 wt. % COOH-groups, based on dry fiber.

6. The modified cellulosic fiber according to claim 1, wherein the amount of the polymeric modifying agent is from 0.75 wt. % to 2.0 wt. %, based on dry fiber.

7. The modified cellulosic fiber according to claim 1, wherein the fiber is capable of providing reversible bonds to another modified cellulosic fiber.

8. A paper comprising the modified cellulosic fiber according to claim 1.

9. A nonwoven product comprising the modified cellulosic fiber according to claim 1.

10. The nonwoven product according to claim 9, wherein the modified cellulose fiber is in an amount of at least 5 wt. %.

11. The nonwoven product according to claim 9, further comprising cellulose, viscose, lyocell, cotton, hemp, manila, jute, sisal, rayon, abacá soft wood pulp, hard wood pulp, synthetic fibers, or heat-sealable fibers, or mixtures thereof.

12. The nonwoven product according to claim 9, wherein the fiber does not comprise or substantially does not comprise any binder.

13. A process for manufacturing the modified cellulosic fiber according to claim 1, comprising the steps of:

providing a cellulosic fiber with the incorporated anionic moieties in an amount of more than 0.25 mol/kg, and treating the cellulosic fiber comprising the incorporated anionic moieties with the polymeric modifying agent comprising cationic moieties with a charge of at least 1.5 meq per gram of polymer.

14. The modified cellulosic fiber according to claim 2, wherein the man-made cellulosic staple fiber is a viscose fiber or a lyocell fiber.

15. The modified cellulosic fiber according to claim 4, wherein the polymeric modifying agent exhibits a molar weight from 200,000 g/mol to 300,000 g/mol.

16. The modified cellulosic fiber according to claim 5, wherein the fiber comprises from 1.5 wt. % to 3 wt. % COOH-groups, based on dry fiber.

17. The nonwoven product according to claim 10, wherein the modified cellulose fiber is in an amount from 25 wt. % to 100 wt. %.

18. The nonwoven product according to claim 17, wherein the modified cellulose fiber is in an amount from 50 wt. % to 80 wt. %.

19. The paper according to claim 8, wherein the modified cellulose fiber is in an amount of at least 5 wt. %.

20. The paper according to claim 19, wherein the modified cellulose fiber is in an amount from 25 wt. % to 100 wt. %.

21. The paper according to claim 20, wherein the modified cellulose fiber is in an amount from 50 wt. % to 80 wt. %.

22. The nonwoven product according to claim 11, wherein the synthetic fiber comprises polyethylene (PE), polypropylene (PP), polyester, polyethylene terephthalate (PET) or poly(lactic acid) (PLA), or mixtures thereof.

23. The nonwoven product according to claim 9, further comprising bicomponent fibers comprising PET/PET fibers, PE/PP fibers, PET/PE fibers or PLA/PLA fibers, or mixtures thereof.

24. The nonwoven product according to claim 23, wherein the bicomponent fibers are sheath-core type fibers.

25. The paper according to claim 8, further comprising cellulose, viscose, lyocell, cotton, hemp, manila, jute, sisal, rayon, abaca soft wood pulp, hard wood pulp, synthetic fibres or heat-sealable fibres.

26. The paper according to claim 25, wherein the synthetic fiber comprises polyethylene (PE), polypropylene (PP), polyester, polyethylene terephthalate (PET) or poly (lactic acid) (PLA), or mixtures thereof.

27. The paper according to claim 8, further comprising bicomponent fibers comprising PET/PET fibers, PE/PP fibers, PET/PE fibers or PLA/PLA fibers, or mixtures thereof.

28. The modified cellulosic fiber according to claim 1, wherein the fiber is dispersible in an aqueous fluid.

29. The paper according to claim 27, wherein the bicomponent fibers are sheath-core type fibers.

* * * * *